US006827598B2

(12) United States Patent
Chang

(10) Patent No.: US 6,827,598 B2
(45) Date of Patent: Dec. 7, 2004

(54) INTEGRATED CIRCUIT CONNECTOR

(75) Inventor: Che-Chia Chang, Taipei Hsien (TW)

(73) Assignee: Comax Technology Inc., Taipei Hsien (TW)

( * ) Notice: Subject to any disclaimer, the term of this patent is extended or adjusted under 35 U.S.C. 154(b) by 0 days.

(21) Appl. No.: 10/421,749

(22) Filed: Apr. 24, 2003

(65) Prior Publication Data

US 2004/0147154 A1 Jul. 29, 2004

(30) Foreign Application Priority Data

Jan. 24, 2003 (TW) ..... 92201416 U

(51) Int. Cl.[7] ..... H01R 4/50; H01R 13/625
(52) U.S. Cl. ..... 439/342; 439/259
(58) Field of Search ..... 439/342, 343, 439/296, 529, 259

(56) References Cited

U.S. PATENT DOCUMENTS 5,688,140 A * 11/1997 McHugh et al. ..... 439/342
5,722,848 A * 3/1998 Lai et al. ..... 439/342
6,368,137 B1 * 4/2002 Orwoll ..... 439/331
6,371,786 B1 * 4/2002 Howell et al. ..... 439/342
6,383,002 B1 * 5/2002 Ohashi ..... 439/259
6,471,536 B1 * 10/2002 Chen et al. ..... 439/342
6,544,065 B1 * 4/2003 Howell et al. ..... 439/342

* cited by examiner

*Primary Examiner*—Michael C. Zarroli
(74) *Attorney, Agent, or Firm*—Troxell Law Office PLLC

(57) ABSTRACT

An integrated circuit connector for a integrated circuit being connected to a circuit board primarily includes a base inserted with terminals, a restrained cover, which is capable of moving horizontally relative to the base, a drive device, which is disposed between the base and the cover and can actuate the base to move relative to the cover, and a locating device, which is arranged to attach to the cover, the base and the drive device to restrain vertical positions of the cover, the base and the drive device so that it is possible to prevent the cover and the base from loosening and to keep the rotational shaft of the drive device in place.

18 Claims, 4 Drawing Sheets

INTEGRATED CIRCUIT CONNECTOR

BACKGROUND OF THE INVENTION

1. Field of the Invention

The present invention relates to an integrated circuit connector and particularly to an integrated circuit connector with zero insertion force.

2. Description of Related Art

Currently used integrated circuit connector primarily includes a cover and a base for being matched to each other and a drive device is disposed between the base and the cover. Usually, the principle of cam is applied to the drive device so that a rectilinear relative motion can be generated between the cover and the base by way of the rotational force to allow the integrated circuit being capable of electrically connecting with the connector.

However, the currently used drive device is simply sandwiched between the cover and the base without any retaining device such that the central shaft of the drive device becomes displaced during the eccentric cam rotating and it results in the cover and the base being incapable of keeping contact tightly because of warping and loosening at the time of the cover moving parallel with the base. In order to overcome the deficiency, a reinforced structure, such as U.S. Pat. No. 5,722,848 (Taiwanese Patent No. 118060), which utilizes a way of hooking for enhancing the effect of joining. The drive device disclosed in U.S. Pat. No. 5,722,848 provides a hook part and an engaging part to prevent the cover and the base from over loosening during parallel moving.

But, the preceding way of engagement is still not possible to solve the problem of misalignment of the central shaft and it makes not only the tool mold hard and complicate to be fabricated but also the assembling process more inconvenient in addition to having difficulty of being disassembled during inspection and maintenance. Further, the reinforced structure is an urged press fit so that it leads to insufficient strength at the reinforced structure due to improper exertion or misused material and causes rupture and damage of the reinforced structure. Hence, a connector with the reinforced structure may occur high defect rate owing to the preceding reasons.

SUMMARY OF THE INVENTION

The crux of the present invention is to overcome the preceding problems to avoid deficiency residing in the integrated circuit connector.

A primary object of the present invention is to provide an integrated circuit connector, which is provided with a locating device attached to the cover, the base and drive device, so as to keep the cover in contact with the base tightly and maintain a relative position of the drive device to the base while the drive device is in rotational motion.

In order to achieve above object, the integrated circuit connector according to the present invention includes: a base providing at least a receiving hole and a terminal in the receiving hole; a cover being restrained and capable of moving horizontally relative to the base and having at least a through hole corresponding to the receiving hole; a drive device disposed between the base and the cover and actuating the base and the cover to move relative to each other by way of rotational movement; and a locating mechanism arranged at the cover, the base and the drive device for restraining the cover, the base and the drive device moving vertically; whereby, the cover can keep contact with the base tightly and a relative position of the drive device to the base can be maintained while the drive device is in rotational motion.

BRIEF DESCRIPTION OF THE DRAWINGS

The present invention can be more fully understood by reference to the following description and accompanying drawings, in which:

FIGS. 4-1 and 4-2 are fragmentary plan views showing states of operation at position A—A in FIG. 1;

FIGS. 5-1 and 5-2 are fragmentary plan views showing states of operation at position B—B in FIG. 1; and FIGS. 6-1 and 6-2 are fragmentary plan views showing states of operation at position C—C in FIG. 1.

DETAILED DESCRIPTION OF THE PREFERRED EMBODIMENTS

Figure 1:
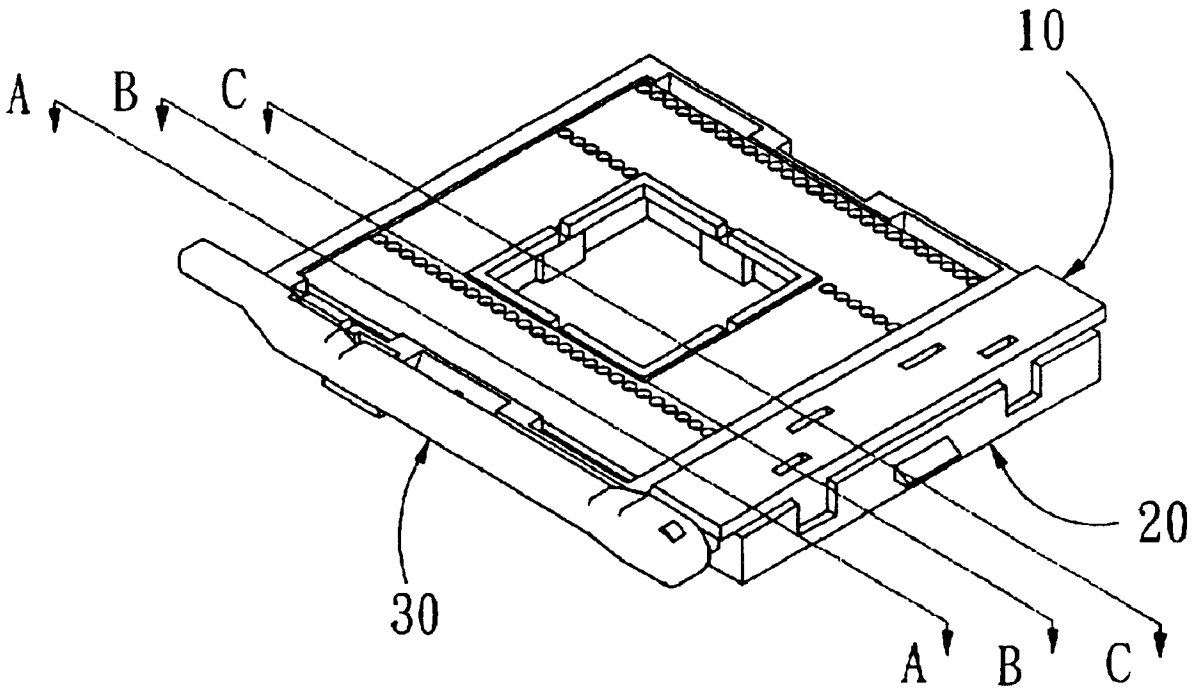
FIG. 1 is a perspective view of an integrated circuit connector according to the present invention.
Figure 2:
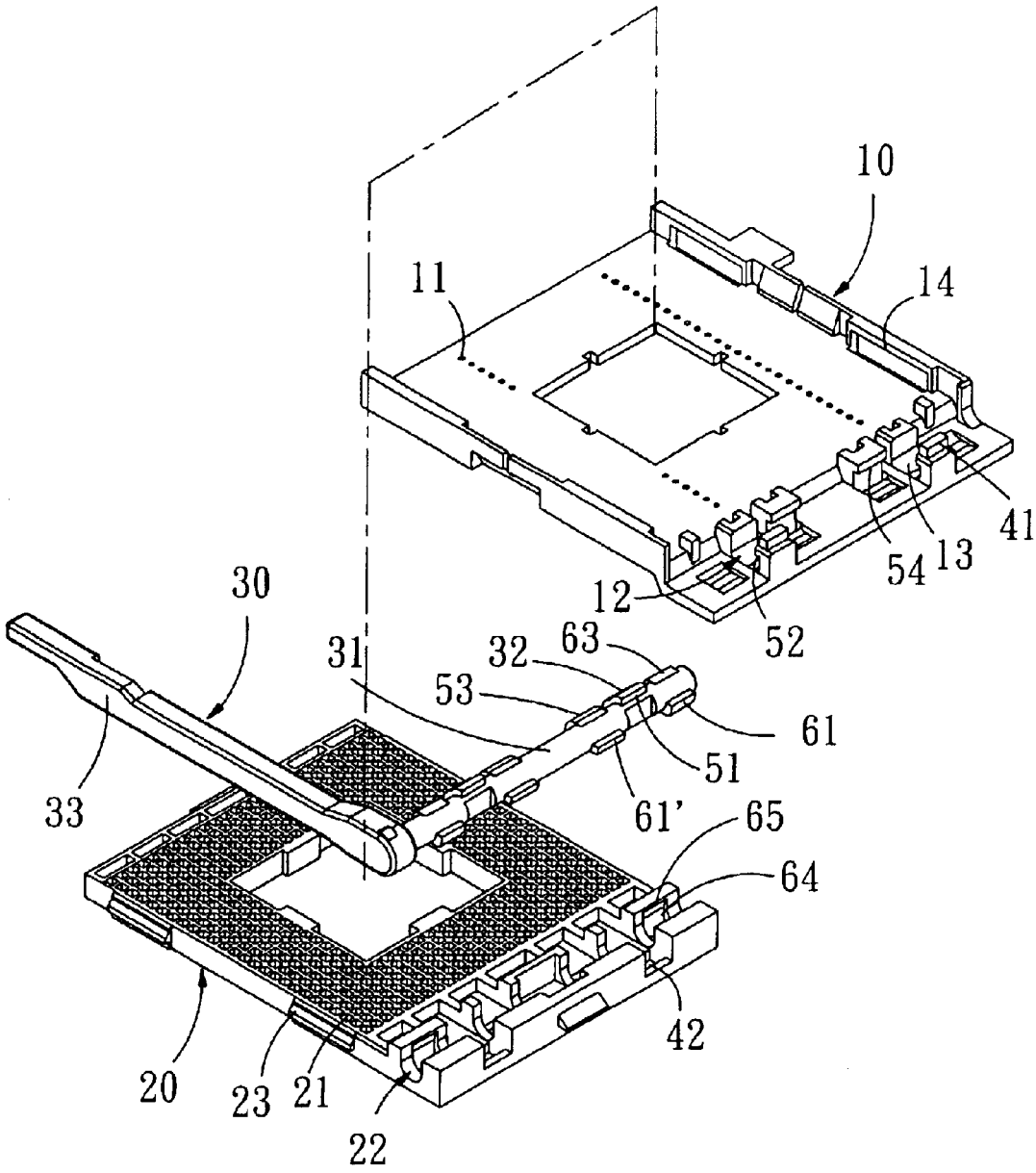
FIG. 2 is a disassembled perspective view of the integrated circuit connector shown in FIG. 1.
Figure 3:
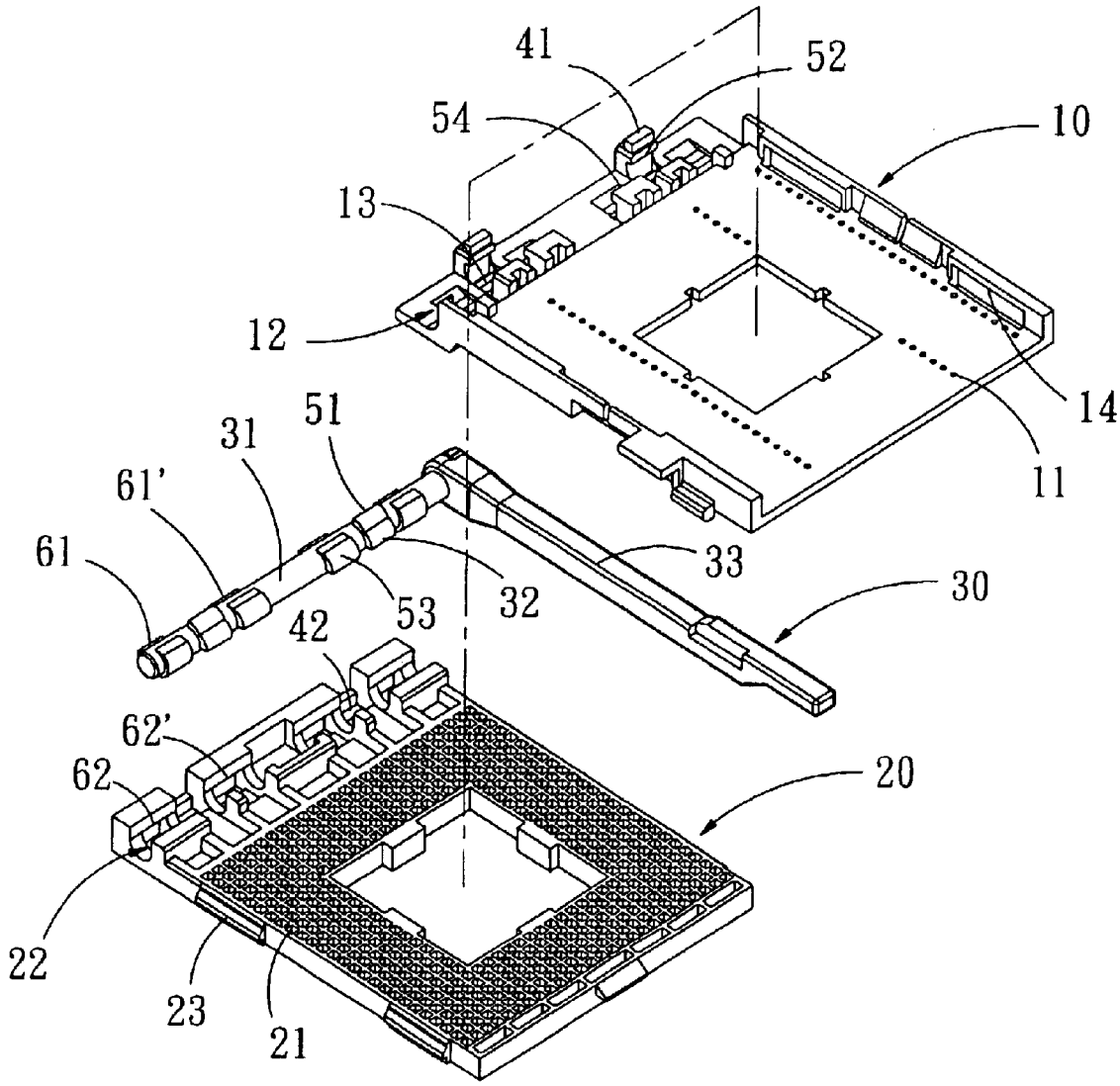
FIG. 3 is another disassembled perspective view of the integrated circuit connector shown in FIG. 1.

Referring to FIGS. 1, 2 and 3, an integrated circuit connector according to the present invention is used for electrically connecting with an integrated circuit (not shown) to a circuit board (not shown) and includes a base 20, a cover 10 contacting with the base 20, a drive device 30, which is disposed between the cover 10 and the base 20 and can be rotated to move the base 20 relative to the cover 10, and a locating device, which is attached to the cover 10, the base 20 and the drive device 30 to restrain vertical positions of the cover 10, the base 20 and the drive device 30. Hence, once a force is exerted to the drive device 30 to actuate the base 20 displacing relative to the cover, the locating device can prevent the cover 10 and the base 20 from loosening and keep the central shaft thereof in place.

The preceding base 20 at the surface thereof provides at least a receiving hole 21 with an inner terminal (not shown) respectively and the cover 10 at the surface thereof provides at least a through hole 11 corresponding to the receiving hole 21 such that the circuit of the integrated circuit can enter the through hole 11 and the receiving hole 21 to connect with the terminal. Besides, the cover 10 at least has a hook part 14 and the base 20 at least has an engaging part 23 at both lateral sides thereof and the hook part 14 corresponds to the engaging part 23 as a matching pair such that the cover 10 and the base 20 can displace relative to each other. Further, the cover 10 and the base 20 at the opposite inner sides thereof is provided with a locating bar 41 and a locating groove 42 respectively to define a horizontal displacement limit for the cover 10 and the base 20 respectively.

The drive device 30 is disposed at a respective lateral side of the base 20 and the cover 10 includes a drive lever 31 and an actuation lever 33, which extends from an end of the drive lever 31 and is perpendicular to the drive lever 31. The cover 10 and the base 20 at the respective side thereof have a first recess 12 and a second recess 22 respectively for positioning the drive lever 31. The first recess 12 at least provides a receiving part 13 and the drive lever 31 has an exertion part 32 for paring with the subjected part 13. The exertion part 32 can be a cam or a gear and the receiving part 13 can be a stop wall extending downward from the cover 10. Thus, the actuation lever 33 is exerted a force, the drive device 30 can be rotated with the drive lever 31 received in the base 20 as an axis in case of the actuation lever 33 being exerted a force and the base 20 and the cover 10 can displace horizontally relative to each other by way of the exertion part 32 on the drive lever 31 being pushed against the subjected part 13 of the cover 10.

Besides, the locating device, which is attached to the cover 10, the base 20 and the drive device 30, includes a first locating mechanism for retraining the drive lever 31 and the cover 10 and a second locating mechanism for restraining the drive lever 31 and the base 20.

The first locating mechanism includes at least a first vertical pressing part 51 at the drive lever 30 and a first vertical pressed part 52 at the cover 10 such that the first vertical pressing part 51 and the first vertical pressed part 52 form a pair to restrain vertical movements of the drive lever 31 and the cover 10. The first locating mechanism further includes at least a first horizontal pressing part 53 at the drive lever 30 and a first horizontal pressed part 54 at the cover 10 such that the first horizontal pressing part 53 and the first horizontal pressed part 54 form another pair to restrain horizontal movements of the drive lever 31 and the cover 10. The pressing parts 51, 53 swell up along radial directions of the drive lever 31 as a jut piece and the pressed parts 52, 54 are hooks extending down from the cover 10 so that the cover 10 is restricted to move vertically by way of turning the drive lever 31 and the pressing parts 51, 53 being actuated to urge against the pressed parts 52, 54. In this way, the cover 10 is limited to move vertically.

The second locating mechanism includes at least two second horizontal pressing parts 61, 61' at the driver lever 30 and two second horizontal pressed part 62, 62' at the base 20 with the second horizontal pressing part 61 pairing with the second horizontal pressed part 62 and the second horizontal pressing part 61' paring the second horizontal pressed part 62'. The second horizontal pressing parts 61, 61' swell up along radial directions of the drive lever 31 as another jut piece and the second pressed parts 62, 62' are flat planes downward from the upper surface of the base 20. The second locating mechanism further includes a limit part 63 provided on the drive lever 31 and a limit groove 64 provided in the base 20 with the limit part 63 paring with the limit groove 64. The limit part 63 has a cross section with a shape of proximate ellipse having a long axis section 63*a* and a short axis section 63*b* and the limit groove 64 at the top thereof has a lip part 65 with a reduced opening only admitting the short axis section of the limit part 63. Hence, the lip part 65 of the limit groove 64 in the base 20 restrains the limit part 63 to keep the rotational axis of the drive lever 31 in place after the drive lever 31 enters the limit groove 64.

As the foregoing, the connector of the present invention can keep the cover 10 and the base 20 being vertically contacted to each other closely regardless it is in a state of connecting, i.e., the actuation lever of the drive device 30 being at a horizontal position, or in a state of releasing, i.e., the actuation lever 33 of the drive device 30 being at a vertical position. Further, the drive lever 31 of the drive device 30 can keep the axial center thereof in place to avoid undesirable quality of electric appliance resulting from warping and loosening.

With reference to FIGS. 4-1, 5-1 and 6-1, the integrated circuit connector of the present invention being in a state of releasing is illustrated. It can be seen in FIG. 4-1, the actuation lever 33 of the drive device 30 is in an upright position and the cover 10 has not moved relative to the base 20 yet. The first horizontal pressing part 53 of the drive device 31 and the first horizontal pressed part 54 of the cover 10 in the first locating mechanism have an open position relative to each other. The second horizontal pressing part 61 of the drive device 31 and the second horizontal pressed part 62 of the base 20 in the second locating mechanism also have an open position relative to each other.

Figures 1, 5:
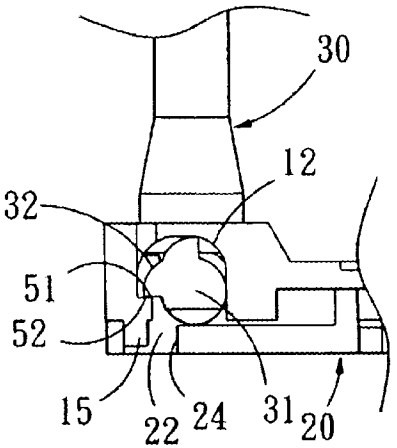
Figures 2, 5:
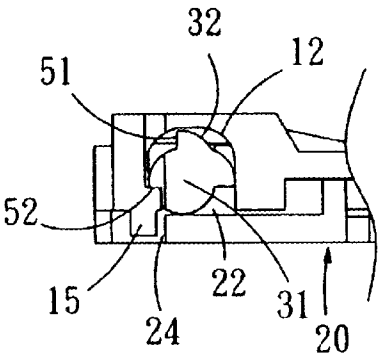
Figures 1, 4:
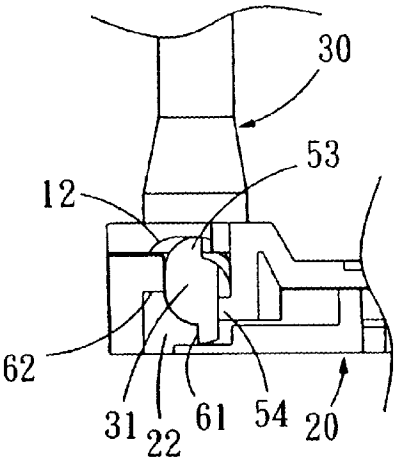
Figures 2, 4:
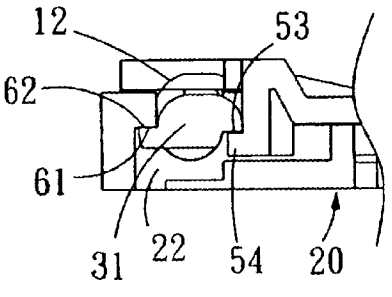

It can be seen in FIG. 5-1 that the first vertical pressing part 51 of the drive lever 31 presses against the first vertical pressed part 52 of the cover 10 in the first locating mechanism. Hence, the cover 10 is capable of pressingly contacting with the base 20 tightly.

Figures 1, 6:
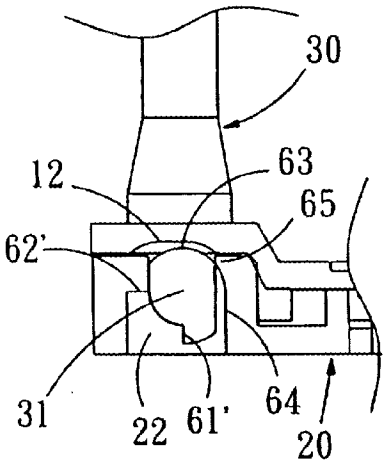
Figures 2, 6:
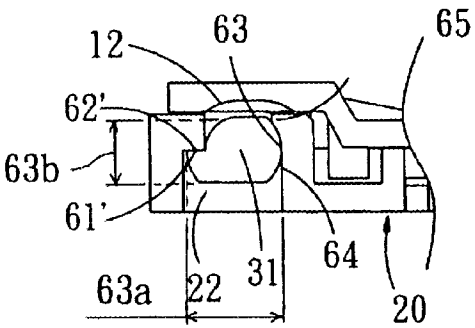

It can be seen in FIG. 6-1 that the second horizontal pressing part 61' of the drive device 30 and the second horizontal pressed part 62' of the base 20 have an open position relative to each other in the second locating mechanism and the limit part 63 just right enters the lip part 65 of the limit groove 64.

Once the integrated circuit (not shown) has been arranged properly, the actuation lever 33, which exerts a force to the drive device 30, makes the drive device 30 rotate in a way of the drive lever 30 acting as a central shaft and makes the exertion part 32 on the drive lever 31 push the receiving part 13 of the first recess 12 in the cover 10 (see FIG. 5-2). In this way, the cover 10 can displace horizontally and the integrated circuit connector can reach to a state of connecting, that is, the actuation lever of the drive device 30 is in a horizontal position.

With reference to FIGS. 4-2, 5-2 and 6-2, the integrated circuit connector of the present invention being in a state of pressing is illustrated. It can be seen in FIG. 4-2 that the first horizontal pressing part 53 of the drive lever 31 presses against the second horizontal pressing part 54 of the cover 10 in the first locating mechanism and the second horizontal pressing part 61 of the drive lever 31 also presses against the second pressed part 62 of the base 20. Thus, the cover 10 can pressingly contact with the base 20 tightly by way of the drive lever 31 exerting a downward force and an upward force to the cover 10 and the base 20 respectively.

It can be seen in FIG. 5-2 that the exertion part 32 of the drive lever 31 pushes against the receiving part 13 of the first recess 12 in the cover 10 so as to allow the cover 10 displacing horizontally. The first vertical pressing part 51 of the drive lever 31 and the first vertical pressed part 52 of the cover 10 in the first locating mechanism are in a state of opening.

It can be seen in FIG. 6-2 that the second horizontal pressing part 61' of the drive lever 31 presses against the second horizontal pressed part 62' of the base 20 and the limit part 63 is restrained by the lip part 65 of the limit groove 54 in the second locating mechanism. Thus, the drive lever 31 is incapable of displacing vertically.

It is appreciated that the integrated circuit connector of the present invention can locate the drive lever 31 of the drive device 30 effectively regardless being in a state of releasing or in a state of connecting. Further, the cover 10 and the base 20 can contact with each other firmly to avoid undesirable quality resulting from warping and loosening.

While the invention has been described with reference to preferred embodiments thereof, it is to be understood that modifications or variations may be easily made without departing from the spirit of the invention, which is defined in the appended claims.

What is claimed is:

1. An integrated circuit connector for electrically connecting an integrated circuit and a circuit board, comprising:

a base, providing at least a receiving hole and a terminal in the receiving hole;

a cover, being restrained and capable of moving horizontally relative to the base and having at least a through hole corresponding to the receiving hole;

a drive device, being disposed between the base and the cover and actuating the base and the cover to move relative to each other by way of rotational movement; and a first locating mechanism located on the cover and the drive device to limit a vertical and a horizontal displacement of the cover and the drive device wherein the first locating mechanism includes:

at least a first vertical pressing part located on the drive device;

at least a first vertical pressed part located on the cover and forming a pair with the first vertical pressing part for restraining the drive device and the cover moving vertically;

at least a first horizontal pressing part located on the drive device; and at least a first horizontal pressed part located on the cover and forming another pair with the first horizontal pressing part pair for restraining the drive device and the cover moving horizontally;

wherein the first vertical pressing part and the first horizontal pressing part are a jut respectively and the first vertical pressed part and the first horizontal pressed part are a hook respectively.

2. The integrated circuit connector as defined in claim 1, wherein the drive device comprises:

a drive lever, being disposed between the base and the cover and received in a first recess in the cover and in a second recess in the base; and an actuation lever, extending laterally from an end of the drive lever.

3. The integrated circuit connector as defined in claim 2, wherein at least a receiving part is provided at the first recess and at least an exertion part is provided at the drive lever with the receiving part and the exertion part forming a matching pair and the exertion part being one of a cam and a gear.

4. The integrated circuit connector as defined in claim 1, wherein the cover at an inner side thereof has a locating bar and the base at an inner side thereof has a locating groove corresponding to the locating bar for defining a horizontal movement.

5. The integrated circuit connector as defined in claim 1, wherein the cover at two lateral sides thereof has a hook part and the base at two lateral sides thereof has an engaging part to constitute a matching pair respectively.

6. An integrated circuit connector for electrically connecting an integrated circuit and a circuit board, comprising:

a base, providing at least a receiving hole and a terminal in the receiving hole;

a cover, being restrained and capable of moving horizontally relative to the base and having at least a through hole corresponding to the receiving hole;

a drive device, being disposed between the base and the cover and actuating the base and the cover to move relative to each other by way of rotational movement; and a locating mechanism, being arranged at the base and the drive device to limit a vertical displacement of the drive device;

wherein the locating mechanism includes:

at least a limit part, being arranged on the drive device and being provided with a cross section thereof having a shape of approximate ellipse with a long axis section and a short axis section; and at least a limit groove, being arranged in the base to form a matching pair with the limit part and at a top thereof being provided with a lip part with a reduced opening for admitting the short axis section of the limit part so as to keep an axial center of the drive device in place during rotation.

7. The integrated circuit connector as defined in claim 6, wherein the locating mechanism comprises:

at least a second horizontal pressing part located on the drive device; and at least a second horizontal pressed part located on the base and forming a pair with the second horizontal pressing part for restraining the drive device and the base moving horizontally;

wherein, the second horizontal pressing part is a jut piece and the second horizontal pressed part is a flat plane.

8. The integrated circuit connector as defined in claim 6, wherein the drive device comprises:

a drive lever, being disposed between the base and the cover and received in a first recess in the cover and in a second recess in the base; and an actuation lever, extending laterally from an end of the drive lever.

9. The integrated circuit connector as defined in claim 8, wherein at least a receiving part is provided at the first recess and at least an exertion part is provided at the drive lever with the receiving part and the exertion part forming a matching pair and the exertion part being one of a cam and a gear.

10. The integrated circuit connector as defined in claim 6, wherein the cover at an inner side thereof has a locating bar and the base at an inner side thereof has a locating groove corresponding to the locating bar for defining a horizontal movement and the cover at two lateral sides thereof at least has a hook part and the base at two lateral sides thereof has an engaging part to constitute a matching pair respectively.

11. An integrated circuit connector for electrically connecting an integrated circuit and a circuit board, comprising:

a base, providing at least a receiving hole and a terminal in the receiving hole;

a cover, being restrained and capable of moving horizontally relative to the base and having at least a through hole corresponding to the receiving hole;

a drive device, being disposed between the base and the cover and actuating the base and the cover to move relative to each other by way of rotational movement; and a locating mechanism, being arranged at the cover, the base and the drive device, further comprising a first locating mechanism limiting a vertical and a horizontal displacement of the cover and the drive device and a second locating mechanism for limiting a vertical displacement of the drive device;

wherein the first locating mechanism includes:

at least a first vertical pressing part located on the drive device;

at least a first vertical pressed part located on the cover and forming a pair with the first vertical pressing part for restraining the drive device and the cover moving vertically;

at least a first horizontal pressing part located on the drive device; and at least a first horizontal pressing part located on the cover and forming another pair with the first horizontal pressing part pair for restraining the drive device and the cover moving horizontally;

wherein, the first vertically pressing part and the first horizontal pressing part preferably are a jut respectively and the first vertical pressed part and the first horizontal pressed part are a hook respectively.

12. The integrated circuit connector as defined in claim 11, wherein the second locating mechanism comprises:

at least a second horizontal pressing part, located on the drive device; and at least a second horizontal pressed part located on the base and forming a pair with the second horizontal pressing part for restraining the drive device and the base moving horizontally;

wherein, the second horizontal pressing part preferably is a jut piece and the second horizontal pressed part is a flat plane.

13. The integrated circuit connector as defined in claim 11, wherein the second locating mechanism further comprises:

at least a limit part, being arranged on the drive device and being provided with a cross section thereof having a shape of approximate ellipse with a long axis section and a short axis section; and at least a limit groove, being arranged in the base to form a matching pair with the limit part and at a top thereof being provided with a lip part with a reduced opening for admitting the short axis section of the limit part so as to keep an axial center of the drive device in place during rotation.

14. The integrated circuit connector as defined in claim 11, wherein the drive device comprises:

a drive lever, being disposed between the base and the cover and received in a first recess in the cover and in a second recess in the base; and an actuation lever, extending laterally from an end of the drive lever.

15. The integrated circuit connector as defined in claim 14, wherein at least a receiving part is provided at the first recess and at least an exertion part is provided at the drive lever with the receiving part and the exertion part forming a matching pair and the exertion part preferably being a cam or a gear.

16. The integrated circuit connector as defined in claim 11, wherein the cover at an inner side thereof has a locating bar and the base at an inner side thereof has a locating groove corresponding to the locating bar for defining a horizontal movement.

17. The integrated circuit connector as defined in claim 11, wherein the cover at two lateral sides thereof at least has a hook part and the base at two lateral sides thereof has an engaging part to constitute a matching pair respectively.

18. An integrated circuit connector for electrically connecting an integrated circuit and a circuit board, comprising:

a base, providing at least a receiving hole and a terminal in the receiving hole;

a cover, being restrained and capable of moving horizontally relative to the base and having at least a through hole corresponding to the receiving hole;

a drive device, being disposed between the base and the cover and actuating the base and the cover to move relative to each other by way of rotational movement; and a locating mechanism, being arranged at the cover, the base and the drive device, further comprising a first locating mechanism limiting a vertical and a horizontal displacement of the cover and the drive device and a second locating mechanism for limiting a vertical displacement of the drive device;

wherein the second locating mechanism further comprises:

at least a limit part, being arranged on the drive device and being provided with a cross section thereof having a shape of approximate ellipse with a long axis section and a short axis section; and at least a limit groove, being arranged in the base to form a matching pair with the limit part and at a top thereof being provided with a lip part with a reduced opening for admitting the short axis section of the limit part so as to keep an axial center of the drive device in place during rotation.

* * * * *